US008701827B2

(12) United States Patent
Taylor

(10) Patent No.: US 8,701,827 B2
(45) Date of Patent: Apr. 22, 2014

(54) CLIMBING SCREEN SUPPORT SYSTEM

(75) Inventor: Mark Taylor, Brighton (GB)

(73) Assignee: Harsco Infrastructure Services Ltd, Leatherwood Surrey (GB)

( * ) Notice: Subject to any disclaimer, the term of this patent is extended or adjusted under 35 U.S.C. 154(b) by 48 days.

(21) Appl. No.: 13/194,499

(22) Filed: Jul. 29, 2011

(65) Prior Publication Data

US 2012/0023839 A1 Feb. 2, 2012

(30) Foreign Application Priority Data

Jul. 29, 2010 (GB) ..... 1012676.1

(51) Int. Cl.
*E04G 3/00* (2006.01)

(52) U.S. Cl.
USPC ..... 182/82; 52/122.1

(58) Field of Classification Search
USPC ..... 52/27, 122.1; 182/82; 248/207, 235, 248/236, 237, 241, 245; 312/201, 334.27, 312/334.29, 334.31–334.35
See application file for complete search history.

(56) References Cited

U.S. PATENT DOCUMENTS

| | | | | | |
|---|---|---|---|---|---|
| 1,692,618 | A * | 11/1928 | Bowers | 384/17 |
| 3,544,186 | A * | 12/1970 | Bjorge Carl | 312/331 |
| 3,650,577 | A * | 3/1972 | Gutner | 384/21 |
| 3,726,416 | A * | 4/1973 | Pottorff et al. | 212/178 |
| 4,444,289 | A * | 4/1984 | Jungman | 182/36 |
| 4,534,600 | A * | 8/1985 | Cosme | 384/23 |
| 4,957,185 | A * | 9/1990 | Courchesne et al. | 182/150 |
| 5,271,585 | A * | 12/1993 | Zetena, Jr. | 248/49 |
| 5,409,191 | A * | 4/1995 | Wenmaekers | 248/317 |
| 6,039,150 | A * | 3/2000 | Palmer | 182/113 |
| 6,305,739 | B1 * | 10/2001 | Corona | 296/165 |
| 7,070,020 | B2 * | 7/2006 | Preston | 182/82 |
| 7,257,925 | B2 * | 8/2007 | Manogue et al. | 52/29 |
| 7,258,198 | B2 * | 8/2007 | Rexroad | 182/138 |
| 7,708,116 | B2 * | 5/2010 | Martin et al. | 182/8 |
| 7,810,890 | B2 * | 10/2010 | Klein et al. | 312/334.33 |
| 2004/0080246 | A1 * | 4/2004 | Michaels | 312/334.5 |
| 2009/0056186 | A1 * | 3/2009 | Pitcher et al. | 40/617 |
| 2009/0079313 | A1 * | 3/2009 | Brunner et al. | 312/334.32 |

FOREIGN PATENT DOCUMENTS

| | | | |
|---|---|---|---|
| DE | 10 2005 030332 | A1 | 1/2007 |
| EP | 1972737 | A2 | 9/2008 |
| EP | 2 365 159 | A1 | 9/2011 |
| GB | 2447710 | A | 9/2008 |

(Continued)

OTHER PUBLICATIONS

European Search Report for Application No. 11175541.9. issued Aug. 27, 2012.

(Continued)

*Primary Examiner* — Adriana Figueroa
(74) *Attorney, Agent, or Firm* — Nutter McClennen & Fish LLP; John J. Penny, Jr.

(57) ABSTRACT

A climbing screen support system comprising a support rail fixable to a surface adjacent an edge of a structure; a mounting arm slidably securable to the rail so as to confine movement of the mounting arm in a linear direction along the support rail; and a climbing shoe attachable to an end of the mounting arm, wherein the support system is configured such that the mounting arm may be securely mounted to the support rail remote from the edge of the structure and subsequently slideable along the support rail such that the climbing shoe protrudes from the edge of the structure by a predetermined distance.

15 Claims, 6 Drawing Sheets

(56) References Cited

FOREIGN PATENT DOCUMENTS

| | | | | |
|---|---|---|---|---|
| WO | 89/12725 | A1 | 12/1989 | |
| WO | 01/34923 | A1 | 5/2001 | |
| WO | 01/53630 | A1 | 7/2001 | |
| WO | WO 2007036300 | A1 * | 4/2007 | ..... E04G 3/28 |
| WO | 2009/062243 | A1 | 5/2009 | |

OTHER PUBLICATIONS

United Kingdom Combined Search and Examination Report issued Nov. 28, 2011 for Application No. GB1012676.1 (4 Pages).

* cited by examiner

CLIMBING SCREEN SUPPORT SYSTEM

BACKGROUND OF THE INVENTION

THE PRESENT INVENTION relates to a climbing screen support system and a method of assembling the same.

When building a construction having a central structure formed by poured concrete, it is known to use a climbing screen system, which encloses the perimeter of at least a part of the construction. The climbing screen system provides a platform around the perimeter of the construction, to support formwork for use in forming the next level of the construction and to provide a useful work space for construction workers. The system includes a safety screen, to safeguard workers from adverse weather conditions and to ensure a safe working environment. As each floor of the construction is formed, the climbing screen moves up the construction, exposing the previously formed floors beneath.

As the construction is formed, it is known to embed attachment devices on the external surfaces, to which climbing shoes may be attached. The climbing screens are attached to vertical rails which are received in the climbing shoes, thereby retaining the climbing screen securely against the construction but allowing vertical movement of the screen (up or down) the construction.

As the climbing screen moves up the building, so there is a need to remove climbing shoes from further down the construction and reattach them at a point above the climbing screen, such that the rail of the climbing screen will be captured and supported by the reattached shoes as the screen vertically translates up the construction. Due to the weight of the climbing screen and associated structure, and the forces experienced by any wind loading of the climbing screen, the climbing shoes, and the attachments to the construction, must be fairly substantial items in order to withstand such forces. Inevitably, the weight of the climbing shoe is such that dropping the shoe onto workers or public below could risk serious injury or death. When detaching and reattaching climbing shoes at the edge of a construction, and particularly at height, it will be appreciated that there is a danger of the climbing shoe, or a part thereof, falling from the construction on to workers or public below.

Accordingly, there is a need for the ability to safely and reliably mount climbing shoes to a construction with a reduced risk of injury to workers and, indeed, damage to the climbing shoe.

When forming a construction from concrete, unavoidable differences in the construction of each floor may mean that the edges of each respective floor are not entirely in line with one another. Sometimes, the edge of a particular floor may be several centimetres out of alignment with the edge of a neighbouring floor. Accordingly, it will be appreciated that where a climbing shoe is attached directly to an attachment point embedded in the edge of a floor, the climbing shoes would also be out of line. Such an arrangement would not allow the free linear movement of a rail with respect to the climbing shoes, because they are not aligned correctly. Accordingly, there is also a need for a climbing screen support system which may alleviate or overcome the inevitable problems of manufacturing tolerances.

BRIEF SUMMARY OF INVENTION

Accordingly, the present invention provides a climbing screen support system comprising a support rail fixable to a surface adjacent an edge of a construction; a mounting arm slidably securable to the rail so as to confine movement of the mounting arm in a linear direction along the support rail; and a climbing shoe attachable to an end of the mounting arm, wherein the support system is configured such that the mounting arm may be securely mounted to the support rail remote from the edge of the construction and subsequently slideable along the support rail into deployment such that the climbing shoe protrudes from the edge of the construction by a predetermined distance.

Further, the present invention provides a method of assembling a climbing screen support system comprising fixing a support rail to a surface adjacent an edge of a construction; providing a mounting arm having a climbing shoe attached to a first end; slidably securing the first end of the mounting arm to the support rail at a point remote from the edge of the construction, so as to confine movement of the mounting arm in a linear direction along the support rail; sliding the mounting arm along the support rail to the extent that the climbing shoe protrudes from the edge of the construction by a predetermined distance.

BRIEF DESCRIPTION OF DRAWINGS

The embodiments of the present invention will now be described, by way of non-limiting example only, with reference to the accompanying figures in which.

DETAILED DESCRIPTION OF INVENTION

Figure 1:
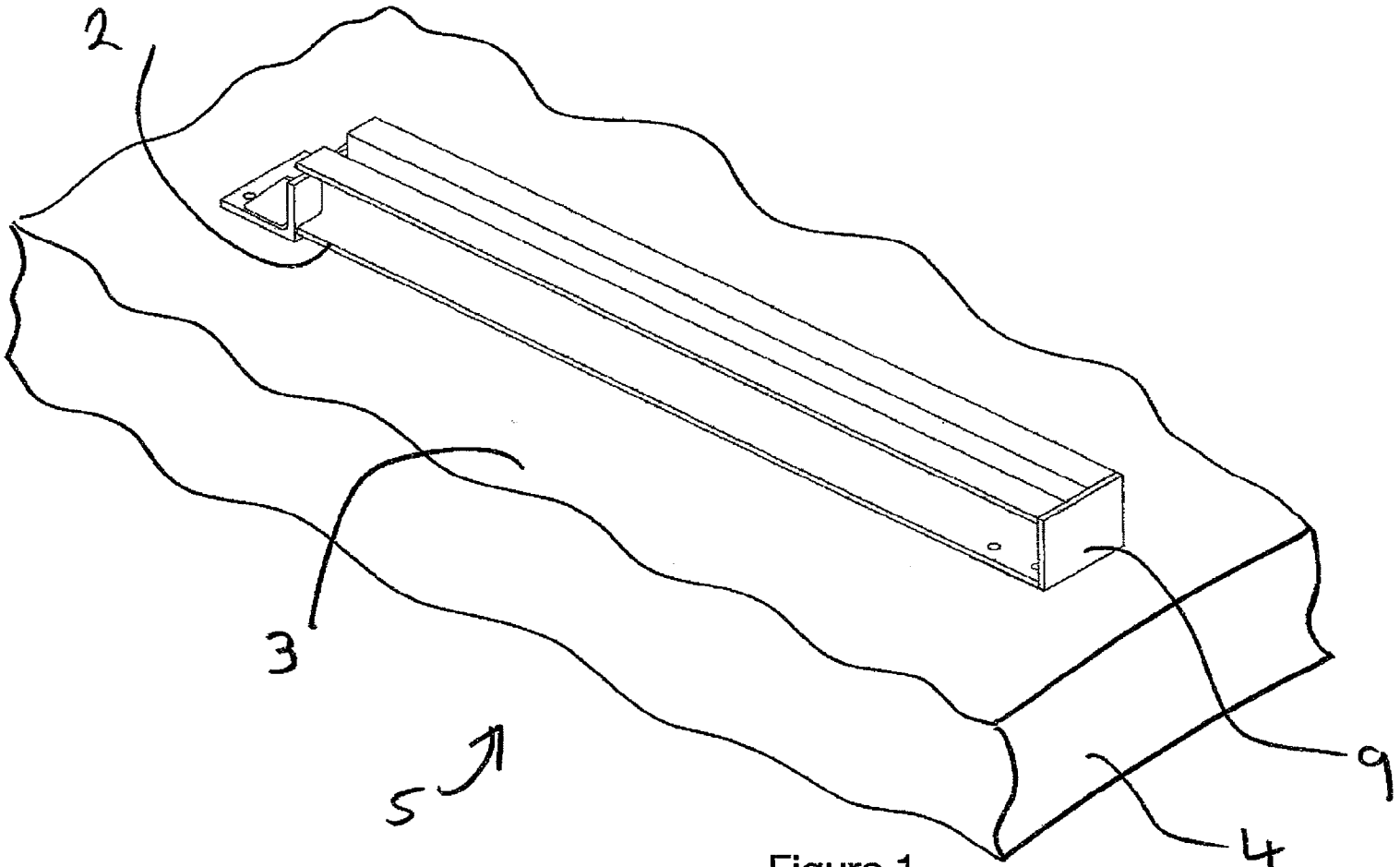
FIG. 1 illustrates a support rail of a climbing screen support system embodying the present invention fixed to the surface of a structure.

With reference to the figures, the present invention provides a climbing screen support system 1 comprising a support rail 2 which is fixable to a surface 3 adjacent an edge 4 of a construction 5. The edge 4 may be the perimeter of the construction 5, and thus adjacent a large vertical drop. The support rail 2 may be fixed to the surface 3 by conventional means. For example, threaded bars may be embedded in the surface 3 of the construction 5, which are received in apertures on the base of the support rail 2. Nuts may secure the support rail 2 to the threaded bars.

The climbing screen support system 1 further comprises a mounting arm 6 slidably securable to the rail 2 so as to confine movement of the mounting arm 6 in a linear direction along the support rail 2. The linear direction is parallel to the longitudinal axis of the support rail 2 and thus the longitudinal axis of the mounting arm 6.

A climbing shoe 7 is attached to an end of the mounting arm 6. The climbing shoe 7 may take a substantially conventional form, such as that disclosed in EP 3.972737, having two pivotable clamps which grasp the vertical rail of a climbing screen. In the embodiment shown in FIG. 1, the clamps of the climbing shoe 7 are attached directly to the mounting arm 6. However, in other embodiments, (not shown), the climbing shoe 7 as a whole may be attached to the mounting arm 6 by a joint to allow rotation with respect to the mounting arm 6 about at least one axis. In one such embodiment, there is a wrist joint provided between the climbing shoe 7 and mounting arm 6 to allow rotation of the climbing shoe 7 about at least two perpendicular axes with respect to mounting arm 6.

The process of how the climbing screen support system is assembled and then deployed will now be explained.

Figure 2:
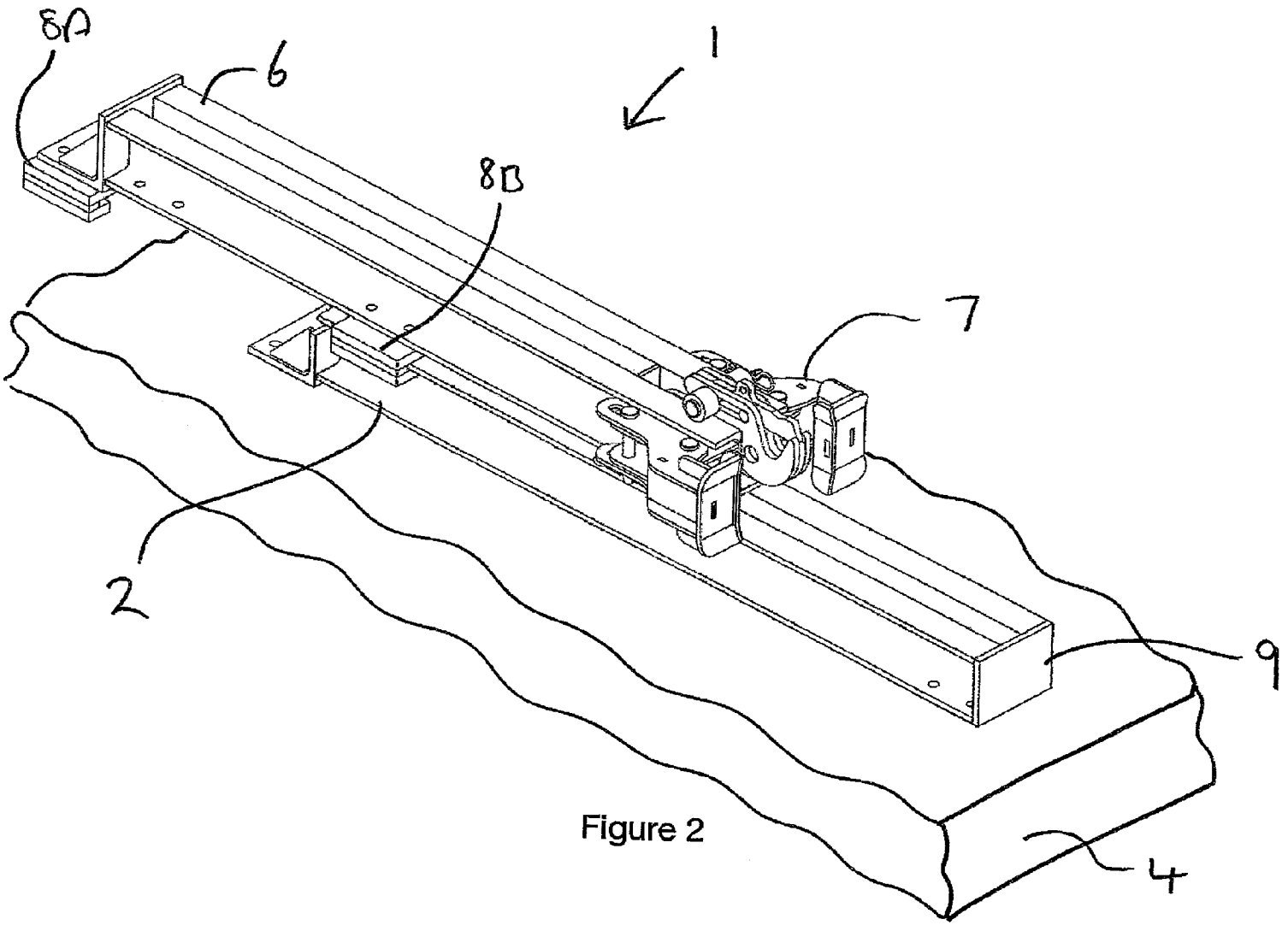
FIG. 2 shows a climbing screen support system embodying the present invention during assembly.

With reference to FIG. 2 the mounting arm 6 is slidably securable to the support rail 2 by means of two brackets 8A, 8B, spaced apart from one another. In the embodiment shown, both brackets 8A, 8B are fixedly secured to the underside of the mounting arm 6 and are configured so as to slidably receive the support rail 2 therein. In the figures, both the support rail 2 and mounting arm 6 each comprise a pair of U-shaped channel sections connected to one another at the bases of each channel section so to present the general shape of an I-beam. The rail may alternatively comprise an I-beam. In FIG. 2, bracket 8B is shown to have captured the upper flange of the support rail 2. It will be appreciated that other shapes of rail 2 and arm 6 are applicable.

As the climbing screen support system is first being assembled, as shown in FIG. 2, the mounting arm 6 is substantially secured to the support rail 2 by means of the bracket 8B. As a result, movement of the mounting arm 6 is substantially confined in a linear direction along the longitudinal axis of the support rail 2. It will thus be appreciated that the mounting arm 6 and climbing shoe 7 are secured to the construction 5 in a substantially safe manner, with no part of the climbing screen support system 1 protruding beyond the edge 4 of the construction 5, thereby reducing the risk of injury to workers or public.

The next stage in assembling the climbing screen support system is to move the mounting arm 6 in a linear direction towards the edge 4 of the construction 5. As it does so, the second bracket 8A, attached at the distal end of the mounting arm 6 remote from the climbing shoe 7, also comes into engagement with the flange of the support rail 2 remote from the edge 4 of the construction. Consequently, the mounting arm 6 is now slidably secured to the support rail 2 by means of both brackets 8A, 8B. The attachment of the mounting arm 6 of the support rail 2 by means of the brackets strictly confines the respective movement of the mounting arm 6 and support rail 2 in a linear direction along the longitudinal axis of the support rail 2.

The mounting arm 6 is then slid with respect to the support rail 2 so that the climbing shoe 7 protrudes beyond the edge 4 of the construction 5 by a predetermined distance.

The end of the support rail 2 adjacent the edge 4 of the construction comprises an end stop 9. The end stop 9 prevents bracket 8B sliding off the end of the support rail 2 adjacent the edge 4 of the construction 5, as shown in FIG. 3.

Figure 3:
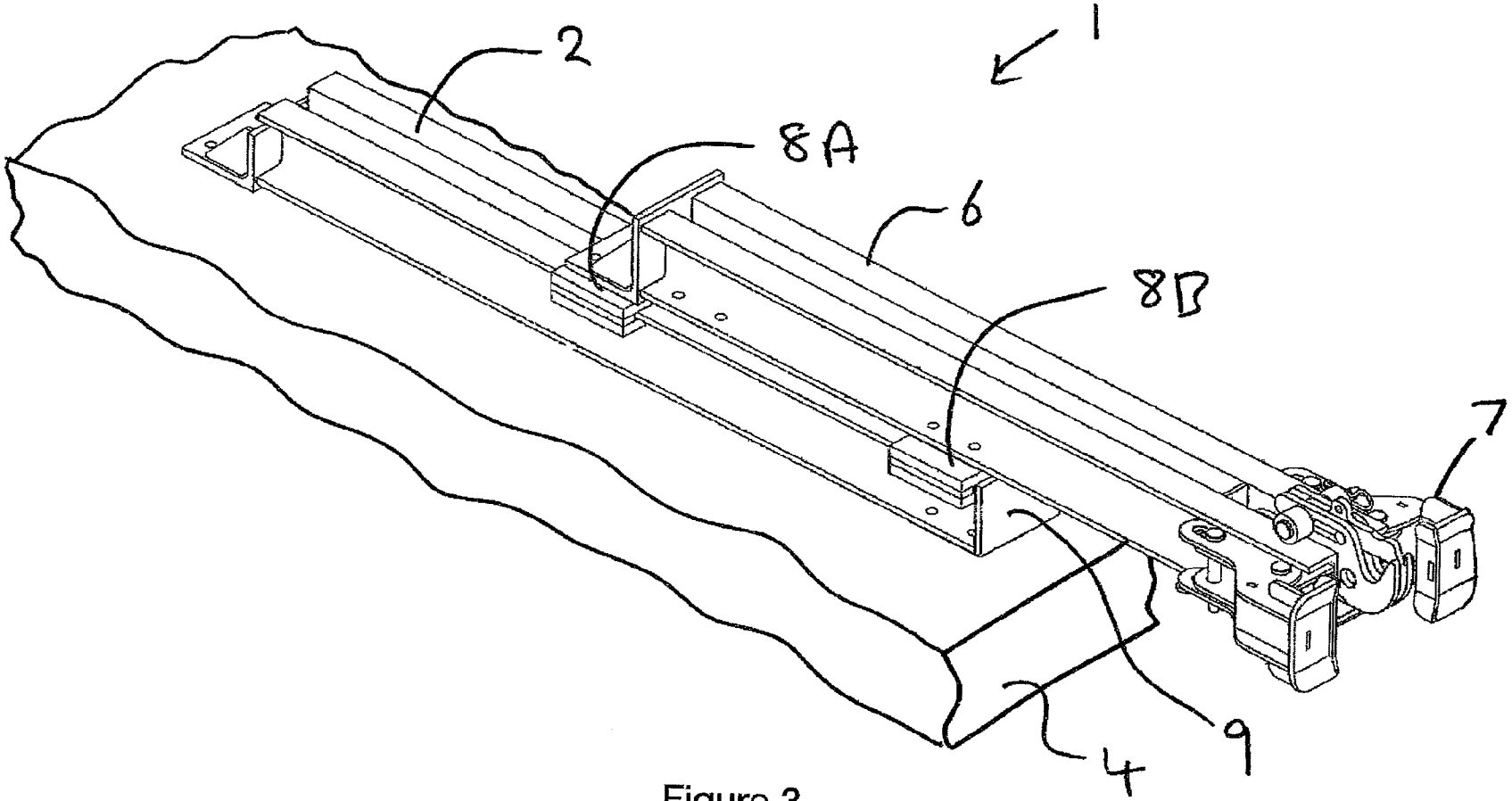
FIG. 3 shows a climbing screen support system embodying the present invention (as shown in FIG. 2) in a deployed configuration.
Figure 4:
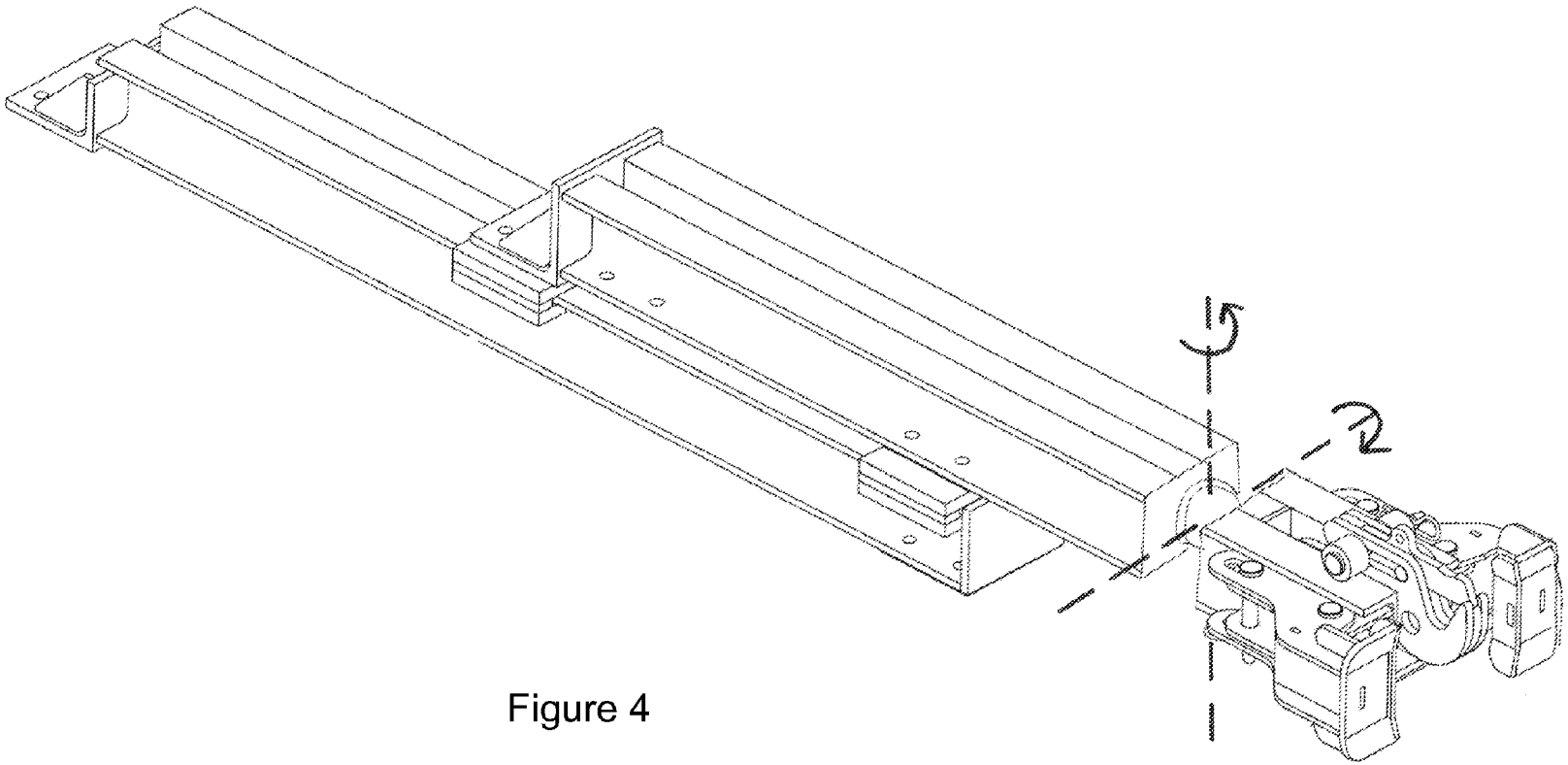
FIG. 4 shows the wrist rotation feature.
Figure 5:
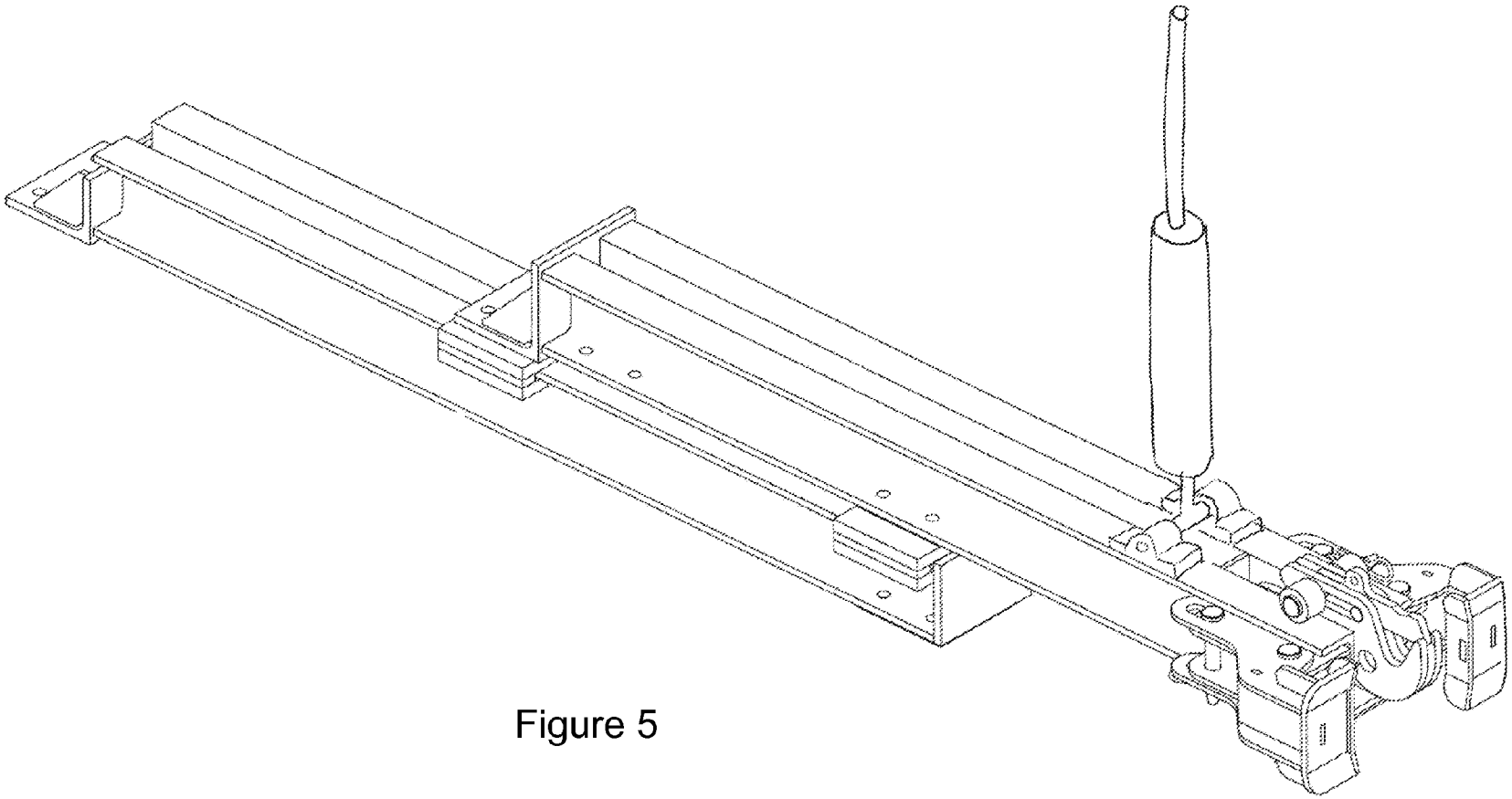
FIG. 5 shows the hydraulic arm.
Figure 6:
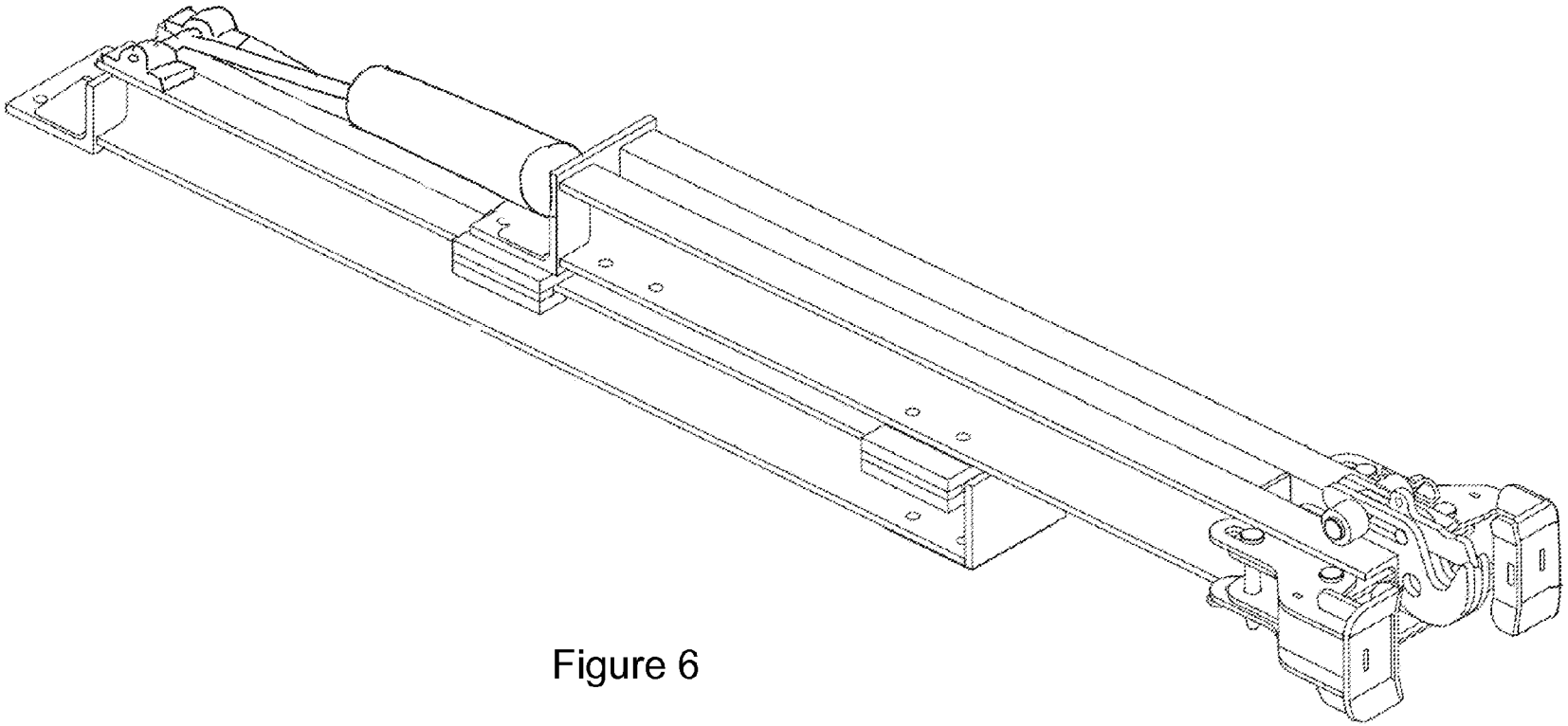
FIG. 6 shows the drive means.

It will be appreciated that, by using a climbing screen support system 1 embodying the present invention, the transition between the configuration shown in FIG. 2 and FIG. 3 provides a fail-safe method of assembly, wherein there is never a risk that the climbing shoe 7 or mounting arm 6 may fall from the construction 5. The only time when the mounting arm 6 is not attached to any item is when it is well clear of the edge 4 of the construction 5. Moreover, it is known to provide additional worker protection around the edge of a floor, such as a handrail fixed to the floor (or the edge of the floor) and a mesh provided between the handrail to the floor. A toe board may also be provided. Preferably, such items can remain in place while the mounting arm is mounted on the rail, reducing still further the risk of any parts of the system falling from the construction. Only when the mounting arm is slidably secured to the rail will the edge protection be lifted to allow the mounting arm and shoe to protrude beyond the edge.

Indeed, the use of two brackets 8A, 8B, actually provides a level of redundancy, wherein failure of one of the brackets 8A, 8B, should not immediately cause parts of the climbing screen support system 1 to fall from the construction 5. In another embodiment, to provide an additional safety feature, the support rail 2 and mounting arm 6 are tethered to one another by means of a chain or cord. The length of the chain or cord is long enough such that the climbing screen support system 1 may be assembled and deployed as described.

In one embodiment (not shown), an attachment point is provided on the mounting arm 6, adjacent the climbing shoe 7, for attachment to screen lifting means. A hydraulic linear actuator may be attached to the attachment point, and used, in conjunction with a screen lifting system, to lift the climbing screen with respect to the construction 5, as is conventional. Alternatively, the screen may be lifted by crane, as is conventional.

In another embodiment (not shown), drive means are provided to control linear translation of the mounting arm 6 with respect to the support rail 2. With reference to FIG. 3, such drive means may be connected between the respective ends of the support rail 2 and mounting arm 6 remote from the edge 4 of the construction 5. Such drive means could then "push" the mounting arm 6 (and climbing shoe 7) towards, and beyond, the edge 4 of the construction 5. In another embodiment (not shown) "pulling" drive means are provided between the end of the mounting arm 6 remote from the edge 4 and the end wall 9 of the support rail 2. The drive means may comprise a hydraulic linear actuator, screw rod or jack, etc.

In one embodiment, the mounting arm 6 is locked with respect to the support rail 2 at a predetermined position. Accordingly, when deployed into the configuration shown in FIG. 3, the position of the mounting arm 6 may be locked with respect to the support rail 2.

Preferably, the mounting arm 6 is moved linearly with respect to the support rail 2 such that the climbing shoe 7 protrudes from the edge 4 of the construction 5 by a predetermined distance. A climbing rail (not shown) may then be engaged with the climbing shoe 7 (or vice versa) to support an associated climbing screen. Linear movement allows the climbing shoe to be aligned with adjacent climbing shoes on other floor, to allow a climbing screen to freely vertically translate up and down the construction.

In another embodiment, the present invention provides a climbing screen support system comprising:

- at least one bracket securable to a surface adjacent an edge of a construction;
- a mounting arm slidably securable to the bracket so as to confine movement of the mounting arm in a linear direction; and
- a climbing shoe attachable to an end of the mounting arm, wherein the support system is configured such that the mounting arm may be securely mounted to the at least one bracket remote from the edge of the construction and subsequently linearly slideable into deployment such that the climbing shoe protrudes from the edge of the construction by a predetermined distance.

Thus, in this embodiment, there is no rail securable to the surface. Instead, at least one bracket is secured to the surface, which bracket slidably receives the mounting arm. Preferably, at least two brackets are secured to the surface, spaced apart from one another. The brackets may be provided on a plate, which plate is secured to the surface.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A climbing screen support system comprising:

a support rail fixable to a surface adjacent an edge of a construction;

a mounting arm slidably securable to the support rail so as to confine movement of the mounting arm in a linear direction along the support rail; and a climbing shoe attachable to an end of the mounting arm, wherein the support system further comprises at least two brackets to slidably secure the mounting arm to the support rail and is configured such that the mounting arm may be securely mounted to the support rail remote from the edge of the construction with no part of the climbing screen support system protruding beyond the edge of the construction, and subsequently slideable along the support rail into deployment such that the climbing shoe protrudes from the edge of the construction by a predetermined distance.

2. A climbing screen support system according to claim 1, wherein the brackets are fixedly secured to the mounting arm and separated by a predetermined distance.

3. A climbing screen support system according to claim 1, wherein the support rail comprises two U-shaped channel sections secured to one another.

4. A climbing screen support system according to claim 1, wherein the climbing shoe is rigidly attached to the mounting arm.

5. A climbing screen support system according to claim 1, wherein the climbing shoe is attached to the mounting arm by a joint to allow rotation with respect to the mounting arm about at least one axis.

6. A climbing screen support system according to claim 1, wherein the mounting arm has an attachment point adjacent the climbing shoe, for attachment to a screen lifting means, which is part of the climbing screen support system.

7. A climbing screen support system according to claim 1, further comprising a drive means for linearly translating the mounting arm with respect to the support rail.

8. A climbing screen support system according to claim 6, wherein the screen lifting means comprises a hydraulic ram.

9. A climbing screen support system according to claim 1, wherein linear translation of the mounting arm with respect to the support rail may be selectively locked.

10. A climbing screen system incorporating the climbing screen support system according to claim 1.

11. A method of assembling a climbing screen support system comprising:

fixing a support rail to a surface adjacent an edge of a construction;

providing a mounting arm having a climbing shoe attached to a first end;

providing at least two brackets for slidably securing the mounting arm to the support rail;

slidably securing the first end of the mounting arm to the support rail at a point remote from the edge of the construction with no part of the climbing screen support system protruding beyond the edge of the construction, so as to confine movement of the mounting arm in a linear direction along the support rail;

sliding the mounting arm along the support rail to the extent that the climbing shoe protrudes from the edge of the construction by a predetermined distance.

12. A method according to claim 11, wherein the step of slidably securing the mounting arm to the support rail comprises securing the mounting arm to the support rail at two spaced-apart locations.

13. A method according to claim 11, comprising the further step of locking the mounting arm with respect to the support rail.

14. A climbing screen support system according to claim 7, wherein the drive means comprises a hydraulic ram.

15. A method according to claim 12, comprising the further step of locking the mounting arm with respect to the support rail.

* * * * *